United States Patent [19]

Hodge

[11] 4,067,145

[45] Jan. 10, 1978

[54] SPRING LOADED ACCESS DOOR

[75] Inventor: Norman J. Hodge, Peoria, Ill.

[73] Assignee: Caterpillar Tractor Co., Peoria, Ill.

[21] Appl. No.: 733,551

[22] Filed: Oct. 18, 1976

[51] Int. Cl.[2] ..... E05F 1/12

[52] U.S. Cl. ..... 49/386

[58] Field of Search ..... 49/386, 394

[56] References Cited

U.S. PATENT DOCUMENTS

| | | | |
|---|---|---|---|
| 1,532,245 | 4/1925 | Kaser | 49/394 X |
| 1,720,789 | 7/1929 | Heusser | 49/386 X |
| 1,817,976 | 8/1931 | Elliott | 49/386 X |
| 2,220,766 | 11/1940 | Hubbs | 49/386 X |
| 2,909,254 | 10/1959 | Hallock | 49/386 |

*Primary Examiner*—Kenneth Downey
*Attorney, Agent, or Firm*—Phillips, Moore, Weissenberger, Lempio & Majestic

[57] ABSTRACT

The invention is concerned with a spring loaded access door which comprises a door fitting over an opening through a wall of a compartment with the door being positionable to cover the opening. Most particularly the invention is concerned with an improved means for mounting a door to a compartment such as an engine compartment whereby the door can be stably fastened in either of two stable positions, in the first of which it is spring loaded closed and in the second of which it is spring loaded open. The improved mounting means comprises a first member extending inwardly of the compartment from the wall thereof adjacent a first side of the opening having a first post extending generally perpendicularly therefrom away from said opening and generally parallel thereto; a first bracket extending inwardly of the compartment from the door adjacent and parallel to the first member on an opposite side thereof from said first post, said first bracket having a second post extending therefrom past the first member and generally parallel to, spaced latitudinally from, proceeding generally in the same direction as and generally of about equal length with the first post. Means are provided biasing the first and second posts towards one another. Also, first means pivotally couple the first bracket to the first member at a position intermediate the door and the first post to define a first and a second position for the door, the door being biased in each of the positions by the biasing means to be stably held in place, said first pivotal coupling means being located in an area defined by a first line connecting the centers of the posts in the first position, a second line connecting the centers of the posts in the second position and the door when in the first and second positions.

9 Claims, 3 Drawing Figures

FIG_3
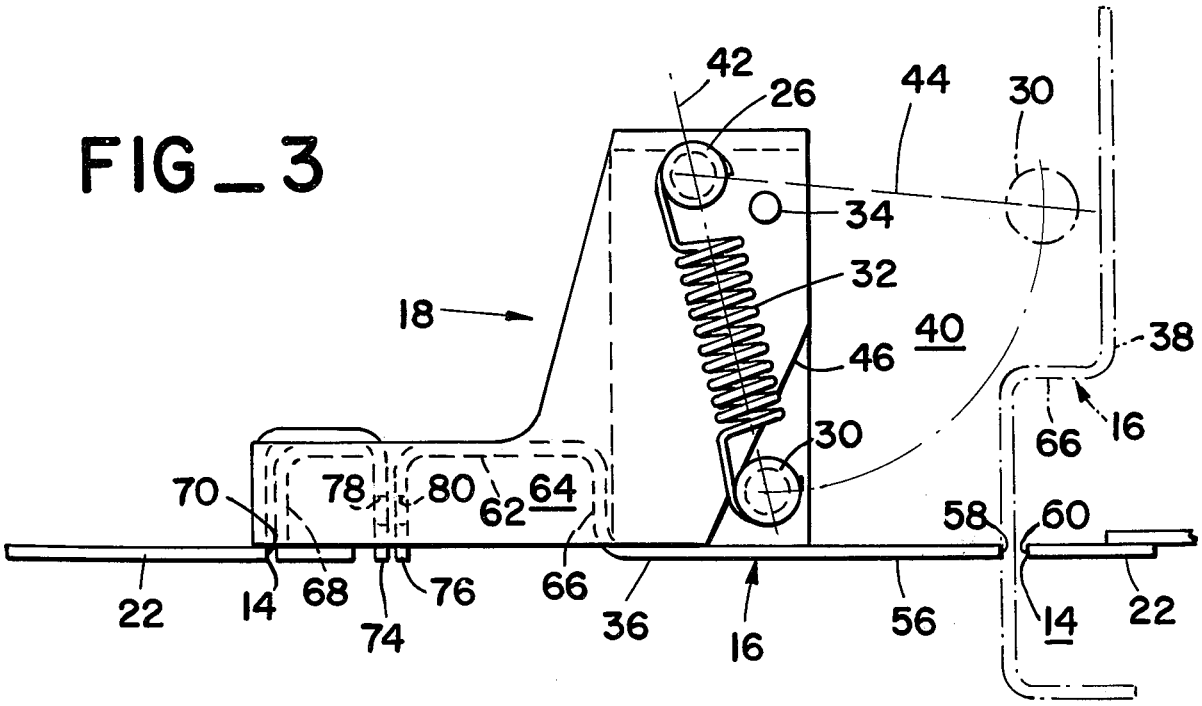
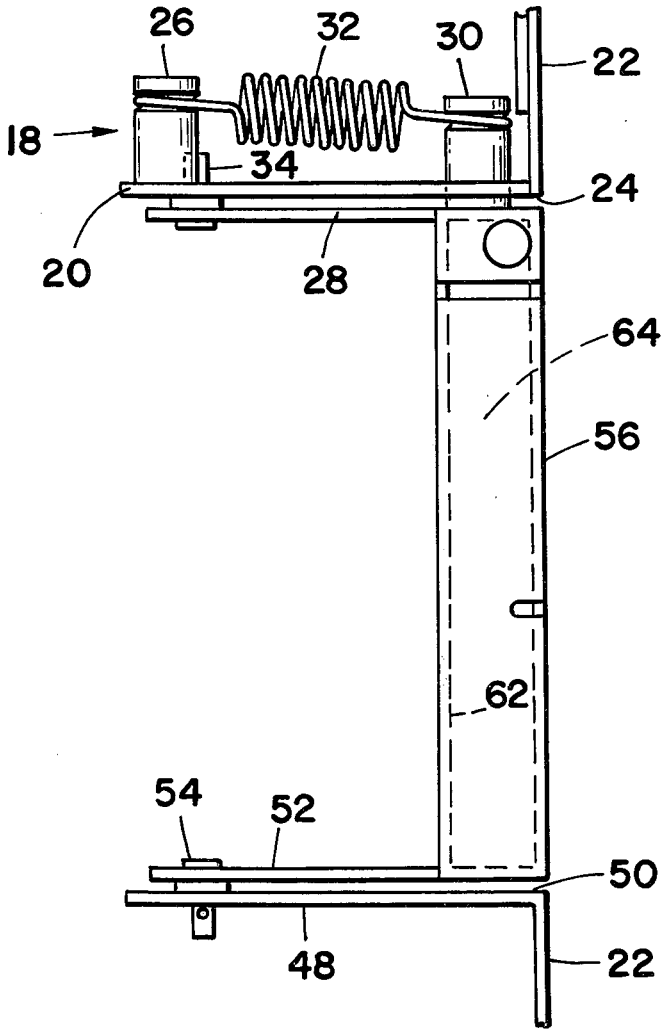
FIG_2

SPRING LOADED ACCESS DOOR

BACKGROUND OF THE INVENTION

1. Field of the Invention

The invention is concerned with access doors to provide entry to otherwise closed compartments such as the engine compartment of a vehicle. More particularly the invention is concerned with access doors which can be rotated into either an open position or a closed position. Still more particularly, the invention is concerned with a particular access door and the design therefor, which particular access door is fastenable in either of two stable positions, one corresponding to the door being closed and the other corresponding to the door being opened, under the impetus of biasing means. In specific embodiments of the invention the door may also be locked or otherwise fastened in it's closed position.

2. Prior Art

It is well known to provide any number of movable panels for entry into otherwise closed compartments. For example, U.S. Pat. No. 3,873,148 and U.S. Design Patent No. 203,620, both commonly assigned herewith disclose access panels leading to the interior of an engine compartment of a vehicle. Often, the prior art access doors have required the fastening or unfastening of a number of bolts or the like to allow their removal thereby providing access to the interior of a compartment such as the engine compartment of a vehicle. Some access panels of the prior art have at times not provided sufficiently safe means for fastening them closed whereby unauthorized persons in the vicinity of such vehicles have been able to obtain access to the interior of the engine compartment or other compartments thereof thereby causing damage either to themselves or to the vehicle.

The present invention is concerned with a particularly structured access door which allows quick entry into a compartment such as the engine compartment of a vehicle, which is biased to be stably positionable in either an open or closed position and in which in certain preferred embodiments of the invention can be securely fastened to prevent opening thereof by unauthorized persons.

SUMMARY OF THE INVENTION

The invention is concerned with an improved means for mounting a door to a compartment such as the engine compartment of a vehicle. The door is positionable to cover an opening through a wall of such a compartment. The improved mounting means comprises a first member extending inwardly of the compartment from the wall thereof adjacent a first side of the opening having a first post extending generally perpendicularly therefrom away from said opening and generally parallel thereto. The mounting means further includes a first bracket extending inwardly of the compartment from the door adjacent and generally parallel to the first member on an opposite side thereof from the first post, the first bracket having a second post extending therefrom past the first member and generally parallel to, spaced latitudinally from, proceeding generally in the same direction as and generally of about equal length with the first post. Means are provided biasing the first and second posts towards one another. First means pivotally couple the first bracket to the first member at a position intermediate the door and the first post to define a first and second position for the door, the door being biased at each of said positions by the biasing means to be stably held in place, the first pivotal coupling means being located in an area defined by a first line connecting the centers of the post in the first position, a second line connecting the centers of the post in the second position and the door when in the first and second positions.

BRIEF DESCRIPTION OF THE DRAWING

The invention will be better understood by reference to the figures of the drawings wherein like numbers denote like parts throughout and wherein:

FIG. 2 comprises a view taken along the line II—II of FIG. 1; and

FIG. 3 illustrates a view taken along the line III—III of FIG. 1.

DETAILED DESCRIPTION OF THE PREFERRED EMBODIMENT

Figure 1:
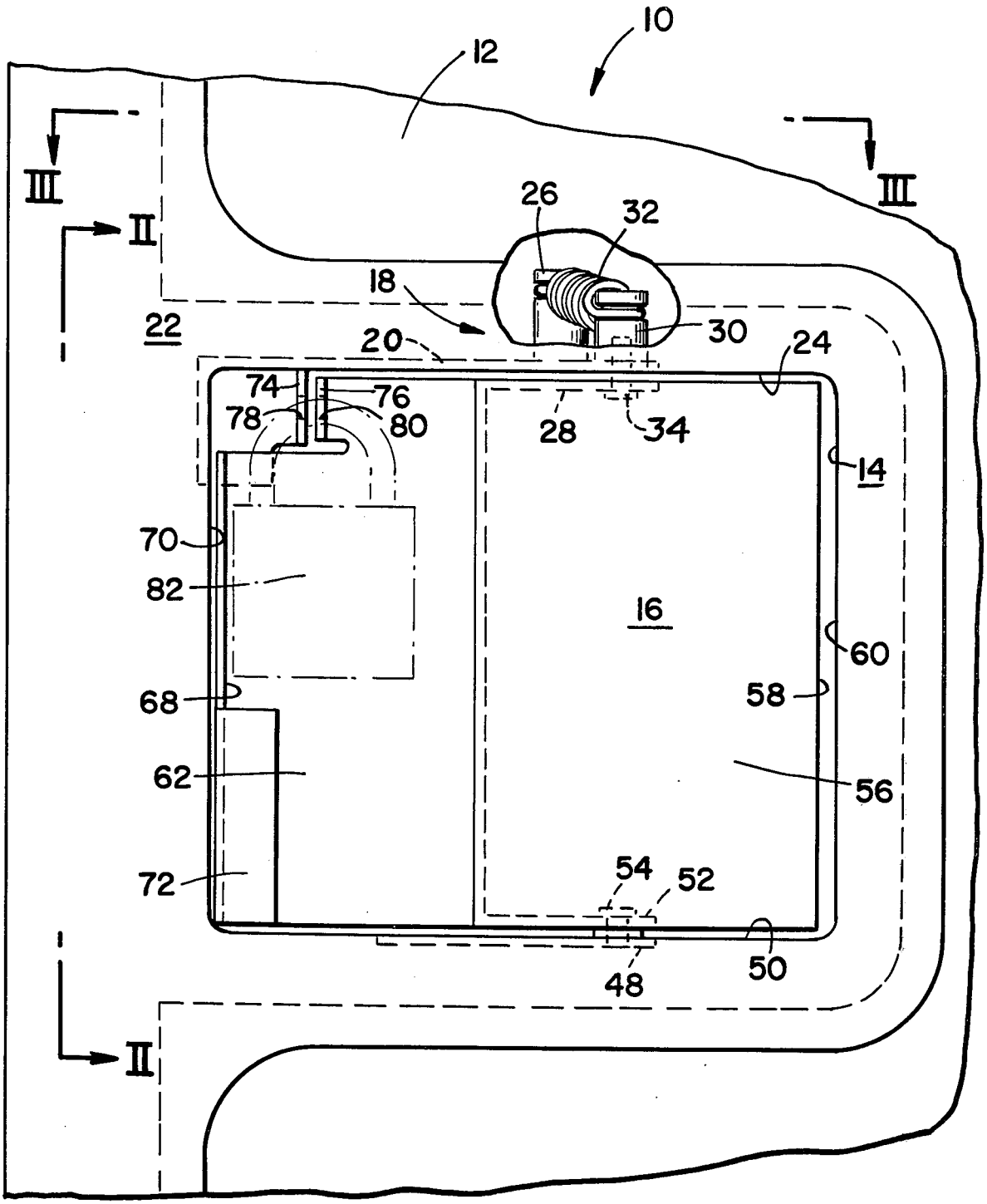
FIG. 1 illustrates in side elevation partially cut away, an improved mounting means of the present invention as attached to an engine compartment of a vehicle.

Referring now primarily to FIG. 1 there is illustrated therein a vehicle 10 having an engine compartment 12 carried thereon with an opening 14 therethrough having a door 16 thereover. An improved mounting means 18 for mounting the door 16 to the engine compartment 12 is illustrated in each of FIGS. 1-3.

The mounting means 18 includes a first member 20 extending inwardly of the compartment 12 from a wall 22 thereof generally perpendicular thereto. The first member 20 is adjacent a first side 24 of the opening 14. The first member 20 has a first post 26 extending generally perpendicularly therefrom, away from the opening 14 and generally parallel thereto and to the wall 22. A first bracket 28 extends inwardly of the compartment 12 from the door 16 adjacent and generally parallel to the first member 20 on an opposite side thereof from the first post 26. The first bracket 28 has a second post 30 extending therefrom past the first member 20 and generally parallel to, spaced latitudinally from, proceeding generally in the same direction as and generally of about equal length with the first post 26. Biasing means, in the embodiment illustrated a spring 32 serves to bias the first post 26 towards the second post 30.

First pivotal coupling means, in the embodiment illustrated a first pivot pin 34 serves to couple the first bracket 28 to the first member 20 at a position intermediate the cover 16 and the first post 26 to define a first stable position 36 for the door 16 as illustrated in FIG. 3 and a second stable position 38 as illustrated in phantom in FIG. 3. The first stable position 36 clearly corresponds to the position wherein the door 16 is in the closed position and the second stable position 38 corresponds to the door 16 being in the open position. The spring 32 as will be explained in following biases the door 16 so that it is stably held in place in either the first stable position 36 or the second stable position 38. The first pivot 34 is located in an area 40 seen most clearly in FIG. 3 which is defined by a first line 42 connecting the centers of the first and second posts 26 and 30 in the first stable position 36, a second line 44 connecting the centers of the first post 26 and the second post 30 in the second stable position 38 and by the door 16 when in the aforementioned first stable position 36 and second stable position 38. Because of the location of the pivot 34 in this area the door 16 is stably positioned by the spring 32 in either the first stable position 36 or the second stable position 38. It will be noted that the first member 20 is cut away on a bias 46 so that the second post 30 can be rotated along with the door 16 to place the door 16 in the first stable position.

The mounting means 18 generally includes a second member 48 extending inwardly of the compartment 12 from the wall 22 thereof parallel to the first member 20 and adjacent a second side 50 of the opening 14, which second side 50 is generally parallel to the first side thereof. A second bracket 52 generally extends inwardly of the compartment 12 from the door 16 adjacent and parallel to the second member 48 and on an opposite side thereof from the first member 20. Second pivotal coupling means, generally a second pivot 54 serves to pivotally connect the second bracket 52 to the second member 48 at a position coaxial with the first pivot 34. Generally, the first pivot 34 is located near to the first post 26 then to the second post 30 whereby the spring 32 can more effectively bias the door 16 in one of the first stable position 36 and the second stable position 38.

In the preferred embodiment of the invention illustrated in the drawings, the door 16 includes a first generally flat portion 56 generally parallel to the wall 22 of the engine compartment 12 with a first end 58 of the door 16 being adjacent a third side 60 of the opening 14. A second generally flat portion 62 of the door 16 is positioned when the door 16 is in the first stable position 36 within the compartment 12 and generally parallel to the first generally flat portion 56 of the door 16 to define a recess 64. Interconnecting means, generally a bent portion 66 of the door 16 in the embodiment illustrated, integrally couples the first generally flat portion 56 and the second generally flat portion 62 of the door 16. A bar 68, generally a bent portion of the door 16 extends from the second generally flat portion 62 to adjacent a fourth side 70 of the opening 14 when the door 16 is in the first stable position 36. Gripping means such as a finger hold 72 which may be formed integrally with the door 16 if desired generally extends from the bar 68 at a position removed from the second generally flat portion 62 towards the first generally flat portion 56 of the door 16.

A first tab 74 in the preferred embodiment of the invention extends from the wall 22 adjacent the fourth side 70 of the opening 14 to adjacent the second generally flat portion 62. A second tab 76 preferably extends from the second generally flat portion 62 to adjacent the first tab 74 when the door 16 is in the first stable position 36. The first and second tabs 74 and 76 generally includes holes 78 and 80 respectively in alignment with one another when the door 16 is in the first stable position 36. Means are generally provided for fastening the first tab 74 to the second generally flat portion 62 of the door 16 and more particularly to the second tab 76 when the door 16 is in the first stable position 36. The preferred fastening means comprises a simple padlock 82 shown in phantom in FIG. 1. It will be noted that the padlock 82 with the cover 16 in the first stable position 36 is within the recess 64 to provide clearance from external vehicle moving parts of vehicle accessory equipment such as lift arms and cylinders on an earth-working vehicle.

While the invention has been described in connection with specific embodiments thereof, it will be understood that it is capable of further modification, and this application is intended to cover any variations, uses or adaptations of the invention following, in general, the principles of the invention and including such departures from the present disclosure as come within known or customary practice in the art to which the invention pertains and as may be applied to the essential features hereinbefore set forth, and as fall within the scope of the invention and the limits of the appended claims.

What is claimed is:

1. In a compartment on a vehicle which includes an opening through a wall thereof and a cover positionable to cover said opening, an improved means for mounting a door to said compartment to serve as said cover, comprising:

a first member extending inwardly of said compartment from the wall thereof adjacent a first side of said opening having a first post extending generally perpendicularly therefrom away from said opening and generally parallel thereto;

a first bracket extending inwardly of said compartment from said door adjacent and generally parallel to said first member on an opposite side thereof from said first post, said first bracket having a second post extending therefrom past said first member and generally parallel to, spaced latitudinally from, proceeding generally in the same direction as and generally of an equal length with said first post;

means biasing said first and second posts towards one another; and first means pivotally coupling said first bracket to said first member at a position intermediate said door and said first post to define a first and a second position for said door, said door being biased at each of said positions by said biasing means to be stably held in place, said first pivotal coupling means being located in an area defined by a first line connecting the centers of said posts in said first position, a second line connecting the centers of said posts in said second position and said door when in said first and second positions.

2. An improved mounting means as in claim 1, including:

a second member extending inwardly of said compartment from the wall thereof parallel to said first member adjacent a second side of said opening which is generally parallel to said first side thereof;

a second bracket extending inwardly of said compartment from said door adjacent and generally parallel to said second member on an opposite side thereof from said first member; and second means pivotally coupling said second bracket to said second member at a position coaxial with said first pivotal coupling means.

3. An improved mounting means as in claim 2, wherein said door includes a first generally flat portion positioned when said door is in said first position generally parallel to the wall of said compartment with a first end thereof adjacent a third side of said opening, a second generally flat portion positioned when said door is in said first position within said compartment generally parallel to said first generally flat portion to define a recess, interconnecting means integrally coupling said first and second generally flat portions and a bar extending from said second generally flat portion to adjacent a fourth side of said opening when said door is in said first position.

4. An improved mounting means as in claim 3, wherein said first pivotal coupling means is nearer to said first post than to said second post.

5. An improved mounting means as in claim 4, including gripping means extending from said bar towards said first generally flat portion.

6. An improved mounting means as in claim 4, including a first tab extending from said wall adjacent said fourth side of said opening to adjacent said second generally flat portion and means for fastening said first tab to said second generally flat portion when said door is in said first position.

7. An improved mounting means as in claim 6, wherein said fastening means comprises a second tab extending from said second generally flat portion to adjacent said first tab when said door is in said first position and said first and second tabs include holes which are in alignment when said door is in said first position.

8. An improved mounting means as in claim 7, wherein said biasing means comprises spring means.

9. An improved mounting means as in claim 8, wherein said fastening means further comprises a padlock fastenable through said holes in said first and second tabs, said padlock fitting within said recess.

* * * * *